United States Patent [19]

Hanlon et al.

[11] Patent Number: 4,680,563

[45] Date of Patent: Jul. 14, 1987

[54] RELAY SWITCH APPARATUS

[75] Inventors: James T. Hanlon, Worthington, Ohio; Paul W. Renaut, Lee's Summit, Mo.

[73] Assignee: American Telephone and Telegraph Company, AT&T Bell Laboratories, Murray Hill, N.J.

[21] Appl. No.: 837,069

[22] Filed: Mar. 6, 1986

[51] Int. Cl.[4] ..... H01H 1/08; H01H 29/00

[52] U.S. Cl. ..... 335/58; 335/57; 200/210

[58] Field of Search ..... 335/58, 57, 55, 49; 200/182, 209, 210

[56] References Cited

U.S. PATENT DOCUMENTS

| | | | |
|---|---|---|---|
| 3,904,999 | 9/1975 | Rich et al. | 335/52 |
| 4,085,392 | 4/1978 | Lacis et al. | 335/58 |
| 4,134,088 | 1/1979 | Asbell et al. | 335/51 |
| 4,148,000 | 4/1979 | Lacis et al. | 335/58 |
| 4,164,720 | 8/1979 | Bollen | 335/47 |
| 4,236,129 | 11/1980 | Lacis et al. | 335/55 |
| 4,368,442 | 1/1983 | Yamaguchi et al. | 335/57 |

FOREIGN PATENT DOCUMENTS

| | | | |
|---|---|---|---|
| 561228 | 6/1977 | U.S.S.R. | 335/58 |

*Primary Examiner*—Harold Broome

*Attorney, Agent, or Firm*—Dwight A. Marshall

[57] ABSTRACT

A multi-positional mercury switch (1) for use with miniature relays (3). The mercury switch apparatus has magnetic contact structures (11, 13, 16, 17) supported in a sealed envelope member (10) with free ends thereof located in the envelope member and positioned to engage or disengage each other in response to a magnetic field generated by current appearing in a coil (310) externally surrounding the envelope member. A magnetic contact structure (11) has a mercury wetted surface (113) and an opening (111) at a free end (116) extending from the mercury wetted surface through the magnetic contact structure for forming a mercury contact (117) opposite the mercury wetted surface.

11 Claims, 3 Drawing Figures

RELAY SWITCH APPARATUS

BACKGROUND OF THE INVENTION

1. Field of the Invention

This invention relates to relay apparatus. In particular, it relates to electromagnetically actuated switches used in relay apparatus.

2. Description of the Prior Art

Sealed contact switches are well known in the Electronic and Communication Industry and have found extensive application in electrical systems performing a wide range of switching functions. A typical switch comprises a pair of reed members or pole-pieces and a stem-armature assembly suspended at their ends by an envelope member, usually glass, such that an armature of the stem-armature assembly overlaps contact surfaces of the pole-pieces. A relay is constructed utilizing a switch such that an electrical winding encircling the envelope member generates a magnetic field for actuating the armature of the switch to engage and disengage contact surfaces of the pole-piece members and thereby control an external electrical circuit connected with the relay. Such switches, serve well in particular circuit applications; however, the irregular surface character of the pole-piece contacts and stem armature reduces the areas of contact upon engagement and renders the switch essentially current limited in that current of a magnitude beyond a predetermined value tends to cause melting of the irregular contact surfaces which increases the tendency of the pole-piece contact and armature to stick together in a closed position.

The current carrying capacities of such switches may be increased by the employment of the well-known mercury-wetted type of switches. Typically, mercury wetted surfaces enable an electrical connection to be uniformly established over the entire surface of the contacts. In such a switch, a pool of mercury located in one end of the envelope moves by capillary action over the stem and armature to wet the contact surfaces of the armature and pole-pieces and thereby increase the current capacity of the switch. A problem occurs with this type of mercury switch in that it is position sensitive. If the switch is mounted in one position, the pool of mercury will shift thereby shorting the reed members or the stemarmature and pole-piece contact surfaces together rendering the switch inoperable. If the switch is mounted in another position, the pool of mercury may be shifted to a location within the switch away from the reed members and from the stem-armature and pole-piece assemblies thereby creating dry contacts that result in a lower current carrying capacity of the switch.

Accordingly, a need exists for a multipositional mercury switch that may be mounted in any position in electrical and electronic equipment.

SUMMARY OF THE INVENTION

The foregoing problems are solved and a technical advantage is achieved by a mercury switch construction comprising contact structures oppositely supported in an envelope member with free ends thereof positioned to engage each other. The contact structures have a mercury wetted surface and an opening at the free end extending from the mercury wetted surface through a contact structure for forming a mercury contact opposite the mercury wetted surface.

In accordance with the invention, a mercury switch construction comprises magnetic contact structures supported in an envelope member and having a generally rectangular, round or D-shaped configured member formed of an oxidized chromium coated mercury wettable magnetic and electrical conducting alloy with an embossment positioned at a free end thereof. A mercury wetted surface is located along one side of the rectangular member opposite the embossment and has mercury holding conduits formed therein. An opening connected with the mercury holding conduits extends through the rectangular member and embossment for forming a mercury contact at the surface of the embossment.

Also in accordance with the invention, a mercury switch construction has magnetic contact structures oppositely supported in an envelope member and comprises a pair of generally rectangular configured members each formed of oxidized chromium coated mercury wettable magnetic and electrical conducting alloy. A mercury wetted surface is located along one side of each rectangular member and has mercury holding conduits formed therein. An opening at a free end of a rectangular member extends from the mercury holding conduits through the rectangular member for forming a mercury contact opposite the mercury wetted surface to engage the other rectangular member.

In further accordance with the invention, a multipositional magnetic mercury relay comprises a housing having terminals extending therefrom and a bobbin located in the housing with an energizing coil wound thereon and connected to ones of the housing terminals. Switch apparatus enclosed by the bobbin is coupled to other ones of the housing terminals for interconnecting the switch coupled terminals in response to electrical signals applied to the coil connected terminals. The switch apparatus comprises an envelope member and a mercury wetted magnetic stem sealed in one end of the envelope member with an end positioned inside the envelope member and another end extended outside the envelope member for interconnection with one of the switch terminals. A mercury wetted armature is positioned inside the envelope member and is attached to the end of the stem positioned within the envelope member. A pole-piece supported at one end of the envelope member opposite the stem is formed of an oxidized chromium coated mercury wettable magnetic and electrical conducting material and has a mercury wettable surface located along one side with an embossment positioned within the envelope member at the free end of the pole-piece opposite the mercury wettable surface for engagement with the armature. The pole-piece has an opening extending through the embossment and pole-piece to the mercury wettable surface for forming a mercury contact at the surface of the embossment opposite the armature.

DESCRIPTION OF THE DRAWING

The foregoing as well as other objects, features and advantages of the invention will be more apparent from a description of the drawing in which.

DESCRIPTION OF THE INVENTION

Figure 1:
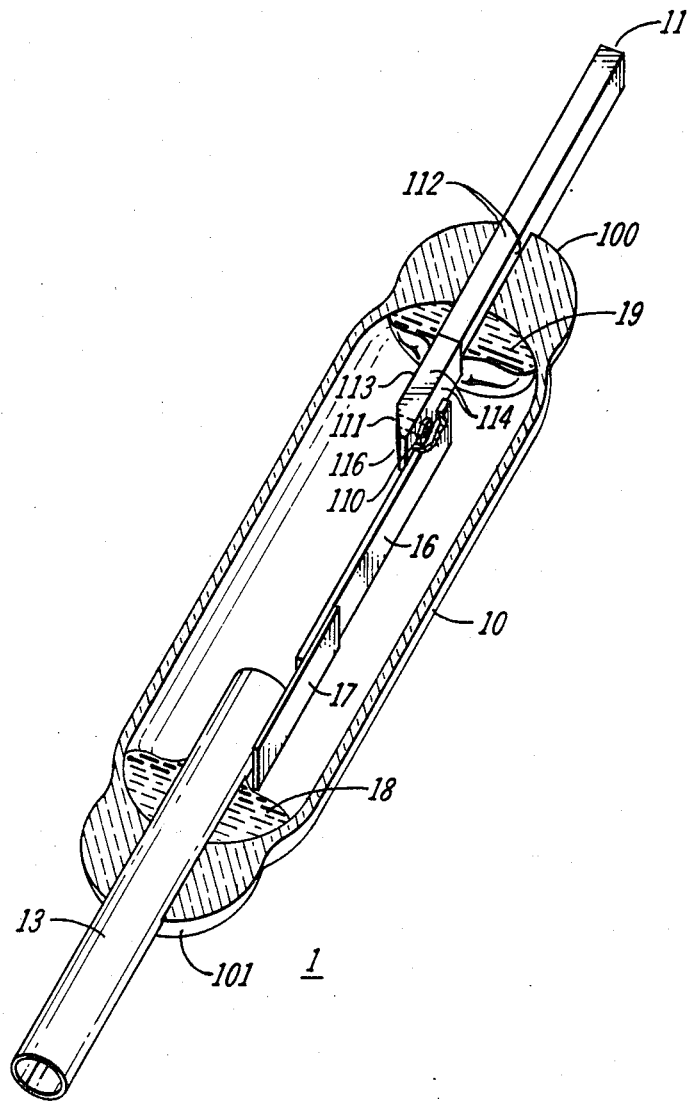
FIG. 1 is a perspective view illustrating switch apparatus embodying the principles of the instant invention.

Referring now to FIG. 1 of the drawing, switch apparatus 1 set forth therein is a mercury switch construction having magnetic contact structures wherein an electrical conducting path may be established between the magnetic contact structures by operation of the switch. More specifically, in a first embodiment of the invention, mercury switch apparatus 1 has one magnetic contact structure comprising a stem 13 formed of a mercury wettable magnetic and electrical conducting material such as a nickel-iron alloy that is sometimes referred to as a type 52 alloy. An armature 16 formed of a mercury wettable magnetic material such as a nickel-iron alloy, for example 78 alloy, is attached by a mercury wettable molybdenum permalloy flexible hinge 17 to one end of stem 13 and is free to move with respect thereto. Stem 13 is supported at one end 101 of a sealed envelope member 10 that typically may be, although not limited thereto, a glass envelope such that armature 16 is positioned within envelope member 10 and the opposite end of stem 13 extends outside of envelope member 10 for interconnection with an external electrical circuit.

Figure 2:
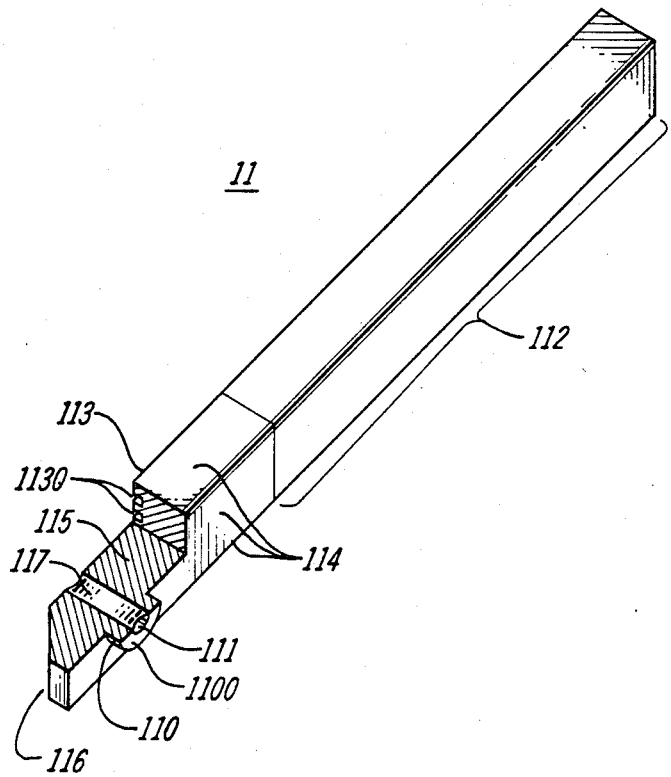
FIG. 2 depicts in perspective view the details of a mercury wettable magnetic contact structure that may be used in the switch apparatus set forth in FIG. 1, and FIG. 3 sets forth a perspective view of a multi-positional mercury relay employing the switch apparatus set forth in FIGS. 1 and 2.

Another mercury wetted magnetic contact structure, such as magnetic pole-piece 11, is supported at end 100 of envelope member 10 opposite stem 13 with a free end 116 extending into envelope member 10 and positioned adjacent armature 16 and the opposite end 112 extended outside of envelope member 10 for interconnection with the external electrical circuit. Referring to FIG. 2 of the drawing, pole-piece 11 set forth therein is a generally rectangular, round or D-shaped configured member formed of a mercury wettable magnetic and electrical conducting material 115 such as the aforementioned nickel-iron alloy. During manufacture, pole-piece 11 may have a mercury wettable embossment 110 formed at end 116 thereof. Pole-piece 11 is chromium plated and oxidized to form non-mercury wettable surfaces 114. Chromium plated pole-piece 11 has a surface opposite embossment 110 that may be masked during the plating operation, ground or subjected to an electronic discharge to form a mercury wettable surface 113 located along side of pole-piece 11 and extending from mercury wettable surface 112 to the embossed end of pole-piece 11.

Conduits 1130, which typically may be parallel V-shaped grooves, are formed in mercury wetted surface 113 and extend along the length of mercury wetted surface 113. An opening 111, connected with conduits 1130, is formed in end 116 of pole-piece 11 from mercury wetted surface 113 through pole-piece 11 and embossment 110. Also in accordance with the invention, a layer of the oxidized chromium may be removed or omitted from a portion of pole-piece 11 to form a mercury wettable area 112 around pole-piece 11 and which is connected with mercury wettable surface 113.

In assembly, pole-piece 11 is supported in end 100, FIG. 1, of envelope member 10 with end 100 sealed around surface 112 and is supported therein with end 116 located within envelope member 10 and embossment 110 positioned to engage armature 16. During the assembly process, mercury is inserted into envelope member 10, for example, through a hollow stem 13 which is subsequently sealed and switch apparatus 1 processed to wet armature 16 and mercury wettable surface 113 and 112 of pole-piece 11. The mercury layer appearing on mercury wetted surface 113 of pole-piece 11, FIG. 2, wets the internal surface of opening 111 thereby forming a mercury contact 117 at surface 1100 of embossment 110.

In one position of switch apparatus 1, FIG. 1, a pool of mercury 18 forms in end 101 of sealed envelope member 10 and moves by capillary action along mercury wettable stem 13 and flexible hinge 17 to coat mercury wettable armature 16 with a layer of mercury. Operation of switch apparatus 1 engages mercury wetted armature 16 with pole-piece embossment 110, FIG. 2, thereby splashing mercury into opening 111 and maintaining mercury contact 117 at embossment surface 1100. In addition, the mercury appearing in opening 111 maintains the mercury wetted status of mercury wettable surfaces 113 and 112 of pole-piece 11.

In another position of switch apparatus 1, a pool of mercury 19, FIG. 1, forms in end 100 of sealed envelope member 10. Mercury pools 18 and 19 may both exist; however, the size of the pools will depend upon the mounting position of the switch apparatus. Mercury pool 19 wets mercury wettable area 112 within envelope member 10, FIG. 2, and mercury wettable surface 113 of pole-piece 11 and moves by capillary action along conduits 1130. Mercury holding conduits 1130 provides mercury to opening 111 and the mercury moves along the internal surface of opening 111 to establish and maintain mercury contact 117 at surface 1100 of embossment 110. In the manner above set forth, operation of switch apparatus 1 splashes mercury into opening 110 and onto armature 16, FIG. 1, to maintain mercury contact 117 at end 116 of pole-piece 11 regardless of the mounting position of switch apparatus 1.

In another embodiment of the invention, not set forth in the drawing, switch apparatus 1 may be a transfer contact switch having a pair of pole-pieces 11 with armature 16 normally engaging one pole-piece 11 and operable to engage the other. In yet another embodiment, switch apparatus 1 magnetic contact structures may comprise a pair of reed members each supported in one end 100, 101 of sealed envelope member 10 with free ends thereof located within envelope member 10 and each positioned to engage the other. A reed member is a generally rectangular configured member similar to pole-piece 11 set forth in FIG. 2 of the drawing but is formed sufficiently thin to be flexible such that the free end may be positioned by an external magnetic force to engage the free end of the other reed member. Each flexible reed member may be formed of an oxidized chromium coated mercury wettable magnetic and electrical conducting material which typically may be a permalloy material. Located along one side of a reed member is a mercury wetted surface having mercury holding conduits formed therein. At the free end an opening extends from the mercury holding conduits through the mercury wettable material of the rectangular reed member so that a mercury contact is formed at the free end of the reed member opposite the other reed member thereby improving the electrical current carrying characteristics of switch apparatus 1.

Figure 3:
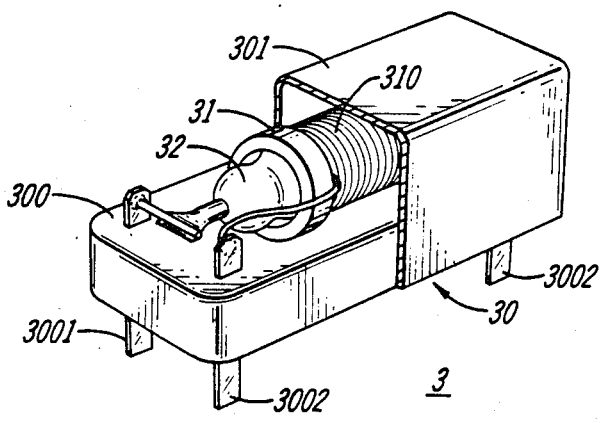

Switch apparatus 1, and various embodiments thereof, may be a part of a multi-positional mercury relay such as magnetic mercury relay 3 set forth in FIG. 3 of the drawing. Relay 3 has a housing 30 comprising a cover member 301 and a base member 300 with a number of terminals 3001, 3002 embedded therein and extending from top and bottom surfaces thereof. Bobbin member 31 is located within housing 30 and has an energizing coil 310 wound thereon with the coil leads connected to base terminals 3002. Switch apparatus 32 may be switch apparatus 1 as set forth in FIG. 1 and is enclosed by bobbin member 31 and energizing coil 310 with the switch stem 13, pole-pieces 11 or reed members, coupled to other base member terminals 3001. Electrical signals applied to the coil terminals 3002 enable switch apparatus 32 to interconnect stem 13, FIG. 1, via armature 16 with pole-piece 11, thereby establishing electrical paths between terminals 3001. Relay 3 may be a magnetic relay having one or more magnets, not shown in the drawing, which may be positioned within housing 30 adjacent switch apparatus 32 to provide a magnetic field defining an initial status of switch apparatus 32.

SUMMARY

It is obvious from the foregoing that the facility, economy and efficiency of mercury relays may be substantially enhanced by mercury switch apparatus that enables a mercury relay to be mounted in any position in electrical and electronic equipment. It is further obvious from the foregoing that a mercury switch construction with magnetic contact structures having a mercury wetted surface and an opening located at a free end and extending from the mercury wetted surface through the magnetic contact structure for forming a mercury contact opposite the mercury wetted surface regardless of the mounting position of the mercury switch construction improves the use of mercury relays in electrical and electronic equipment.

What is claimed is:

1. A mercury switch construction (1) comprising contact structures (11, 13) oppositely supported in an envelope member (10) with free ends thereof positioned to engage each other

CHARACTERIZED IN THAT said contact structures comprises means (11) extending into the envelope member and having a mercury-wetted surface (113) located along one side thereof and having an opening (111) at a free end positioned inside the envelope member extending from said mercury-wetted surface through said means for forming a mercury contact (117) at a surface of said means opposite said mercury-wetted surface.

2. The mercury switch construction set forth in claim 1

CHARACTERIZED IN THAT said mercury contact means comprises means (11) having an embossment (110) formed at said free end opposite said mercury wetted surface and having said opening extending from a surface (1100) of said embossment through said means to said mercury wetted surface for forming said mercury contact at said embossment surface.

3. The mercury switch construction set forth in claim 2

CHARACTERIZED IN THAT said mercury contact means comprises conduit means (1130) formed on said mercury wetted surface for holding mercury and connected with said embossment opening to wet said embossment opening.

4. The mercury switch construction set forth in claim 3

CHARACTERIZED IN THAT said mercury contact means comprises a member (11) formed of an oxidized chromium coated mercury wettable and electrical conducting magnetic alloy having said embossment positioned at the free end (116) thereof and having formed along one side said mercury holding conduits connected by said opening extended through said member to said embossment surface for forming said mercury contact at said embossment surface.

5. The mercury switch construction set forth in claim 4

CHARACTERIZED IN THAT said mercury contact means comprises a generally rectangular configured member (11) formed of said oxidized chromium coated mercury wettable magnetic and electrical conducting alloy having said embossment at the free end thereof and having located along one side opposite said embossment said mercury wetted surface with said mercury holding conduits formed therein and connected by said opening extending through said member and said embossment for forming said mercury contact at said embossment surface.

6. The mercury switch construction set forth in claim 5

CHARACTERIZED IN THAT said mercury contact means comprises said generally rectangular configured member having a mercury wettable area (112) formed around said rectangular member and connected with said mercury wetted surface for coupling said mercury holding conduits with a reservoir of mercury located at an end of said envelope member supporting said rectangular member.

7. The mercury switch construction set forth in claim 1

CHARACTERIZED IN THAT said mercury contact means comprises a pair of generally rectangular configured flexible members (11) each formed of oxidized chromium coated mercury wettable magnetic and electrical conducting alloy having located along one side said mercury wetted surface with mercury holding conduits (1130) formed therein and having said opening at the free end extending from said mercury holding conduits through said rectangular member for forming said mercury contact opposite said mercury contact of said other rectangular member for engagement therewith.

8. The mercury switch construction set forth in claim 1

CHARACTERIZED IN THAT said mercury contact means comprises a mercury wetted stem (13) supported at one end of said envelope member, a mercury wetted flexible armature (16) attached at one end thereof to said stem, and a pole-piece (11) supported at one end of said envelope member opposite said stem and formed of an oxidized chromium coated mercury wetted and electrical conducting alloy with a mercury wetted surface (113) located along one side and having an embossment (110) positioned at a free end (116) opposite said mercury wetted surface for engagement with said armature and having an opening (111) extending through said pole-piece to said mercury wetted surface for forming said mercury contact (117) at a surface of said embossment adjacent said armature.

9. A multi-positional magnetic mercury relay (3) comprising a housing (30) having terminals (3001, 3002) extending therefrom, a bobbin (31) located in said housing and having an energizing coil (310) wound thereon with the coil connected to ones of said terminals, and switch means (32) enclosed by said bobbin and coupled to other ones of said terminals for interconnecting said switch terminals in response to electrical signals applied to said coil terminals

CHARACTERIZED IN THAT said switch means comprises an envelope member (10), and a pair of generally rectangular configured flexible members (11) each sealed in opposite ends of said envelope member with free ends (110) thereof positioned inside said envelope member to engage each other and the opposite ends (112) extended outside of said envelope member for interconnection with said switch terminals and each formed of an oxidized chromium coated mercury wettable magnetic and electrical conducting alloy having located along one side a mercury wetted surface (113) with mercury holding conduits (1130) formed therein and having an opening (111) at said free end extending from said mercury holding conduits through said rectangular member for forming a mercury contact (117) opposite said mercury wettable surface and adjacent a mercury contact of said other rectangular member.

10. A multi-positional magnetic mercury relay (3) comprising a housing (30) having terminals (3001, 3002) extending therefrom, a bobbin (31) located in said housing and having an energizing coil (310) wound thereon with the coil connected to ones of said terminals, and switch means (32) enclosed by said bobbin and coupled to other ones of said terminals for interconnecting said switch terminals in response to electrical signals applied to said coil terminals

CHARACTERIZED IN THAT said switch means comprises an envelope member (10), a mercury wetted magnetic stem (13) sealed in one end (101) of said envelope member with one end thereof positioned inside said envelope member and the other end extended outside said envelope member for interconnection with one of said switch terminals, a mercury wetted armature (17) positioned inside said envelope member and attached to said one end of said stem, and a pole-piece (11) supported at one end (100) of said envelope member opposite said stem and formed of an oxidized chromium coated mercury wettable magnetic and electrical conducting alloy with a mercury wettable surface (113) located along one side and having an embossment (110) positioned at a free end (116) opposite said mercury wetted surface for engagement with said armature and having an opening (111) extending through said pole-piece to said mercury wetted surface for forming a mercury contact (117) at a surface (1100) of said embossment adjacent said armature.

11. A multi-positional magnetic mercury relay (3) comprising a housing (30) having terminals (3001, 3002) extending therefrom a bobbin (31) located in said housing and having an energizing coil (310) wound thereon with the coil connected to ones of said terminals, and switch means (32) enclosed by said bobbin and coupled to other ones of said terminals for interconnecting said switch terminals in response to electrical signals applied to said coil terminals

CHARACTERIZED IN THAT said switch means comprises an envelope member (10), a mercury wettable magnetic stem (13) sealed in one end (101) of said envelope member with one end thereof positioned inside said envelope member and the other end extended outside said envelope member for interconnection with one of said switch terminals, a mercury wettable armature (17) positioned inside said envelope member and attached to said one end of said stem, and a pair of pole-pieces (11) supported at one end of said envelope member opposite said stem with free ends (116) positioned inside said envelope member and the other ends (112) extended outside said envelope member for interconnection with other ones of said switch terminals and each formed of a mercury wettable alloy with an oxidized chromium plated coating at said free end and having a mercury wetted surface (113) located along one side inside said envelope member and having an embossment (110) positioned at said free end opposite said mercury wetted surface for engagement with said armature and having an opening (111) extending through said embossment and pole-piece to said mercury wetted surface for forming a mercury contact (117) at a surface of said embossment opposite said armature.

* * * * *